US005626178A

United States Patent [19]

Merath

[11] Patent Number: 5,626,178

[45] Date of Patent: May 6, 1997

[54] BREAST BOX FOR A PAPERMAKING MACHINE

[75] Inventor: Thomas Merath, Weingarten, Germany

[73] Assignee: Voith Sulzer Papiermaschinen GmbH, Heidenheim, Germany

[21] Appl. No.: 544,152

[22] Filed: Oct. 17, 1995

[30] Foreign Application Priority Data

Oct. 18, 1994 [DE] Germany ..... 9416731 U

[51] Int. Cl.[6] ..... D21F 1/02; D21F 1/08

[52] U.S. Cl. ..... 162/272; 162/336; 162/343; 162/339

[58] Field of Search ..... 162/272, 336, 162/337, 338, 339, 340, 343, 347, 199, 344

[56] References Cited

U.S. PATENT DOCUMENTS

| | | | |
|---|---|---|---|
| 4,406,741 | 9/1983 | Kirjavainen | 162/336 |
| 4,897,158 | 1/1990 | Weisshuhn et al. | 162/259 |
| 5,490,905 | 2/1996 | Houvila et al. | 162/212 |
| 5,545,293 | 8/1996 | Houvilla et al. | 162/212 |

FOREIGN PATENT DOCUMENTS 4019593 1/1992 Germany .

*Primary Examiner*—Donald E Czaja
*Assistant Examiner*—Jose A. Fortuna
*Attorney, Agent, or Firm*—Greenblum & Bernstein P.L.C.

[57] ABSTRACT

Breast box for a papermaking machine. A breast box for a papermaking machine includes at least one distribution device for a material suspension extending over the width of the papermaking machine, at least one adjacent intermediate chamber located downstream of the distribution device, at least one guiding device for the suspension located adjacently downstream of the intermediate chamber, a nozzle chamber, having a wide aperture, located adjacently downstream of the guiding device, with the guiding device, the intermediate chamber and the distribution device being releasably connected with each other, and the intermediate chamber and the distribution device being pivotally journalled about a common fixed pivot axis, with the common pivot axis extending horizontally and laterally to the longitudinal direction of the papermaking machine, with the common pivot axis also extending through at least one pillow block fixedly connected with the seat or the foundation of the papermaking machine.

21 Claims, 1 Drawing Sheet

FIG. 1A
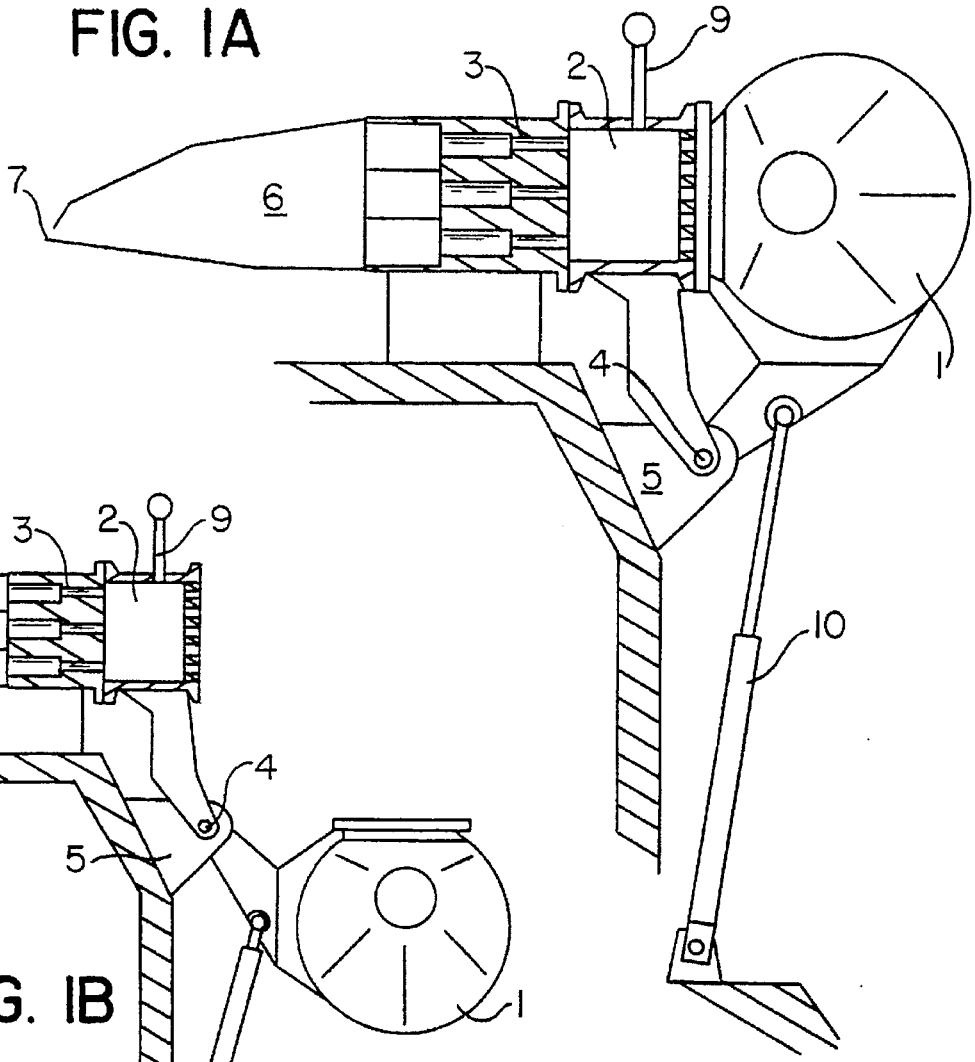
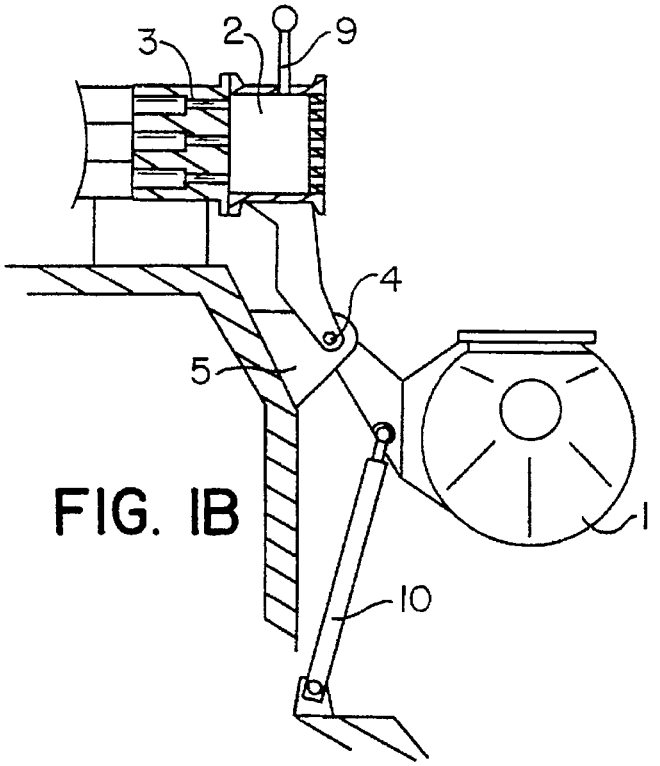
FIG. 1B
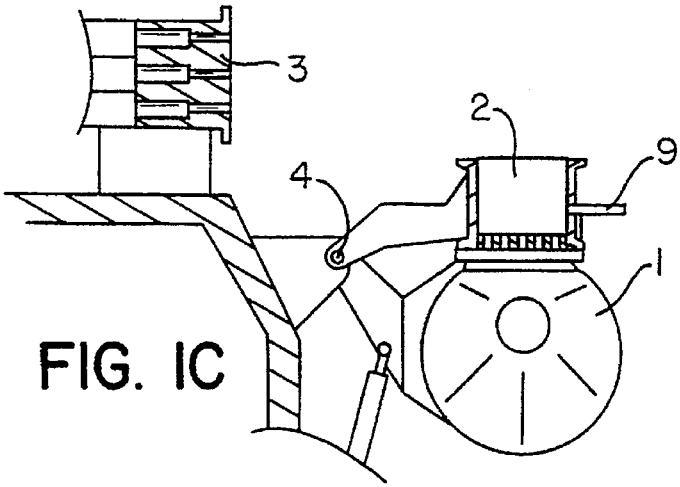
FIG. 1C

BREAST BOX FOR A PAPERMAKING MACHINE

CROSS REFERENCE TO RELATED APPLICATIONS

This application claims the priority of German Application No. DE G 9416731.1, filed Oct. 18, 1994, the disclosure of which is incorporated herein by reference in its entirety.

BACKGROUND OF THE INVENTION

1. Field of the Invention

This invention has its genesis in a breast box for a paper or cartonmaking machine having at least one distribution device, for a material suspension extending over the width of the papermaking machine, at least one adjacent intermediate chamber located downstream of the distribution device, at least one guiding device for the suspension, located adjacently downstream of the intermediate chamber, a nozzle chamber, having a wide aperture, located adjacently downstream of the guiding device, wherein the guiding device, the intermediate chamber and the distribution device are releasably connected with each other.

2. Discussion of the Background of the Invention and Material Information

It is a known requirement for modern breast boxes to be adjustable, at their exit gap or aperture, across the entire width of the suspension mass. Via this measure, for example, the area weight cross section can be controlled or cross currents in the breast box can be prevented. Generally for this purpose, geometric changes are undertaken at the exit gap or aperture, and/or at several places distributed across the width of an intermediate chamber, which is located downstream of the distribution device, fluid is added, with this fluid, such as diluting water, having a consistency or material density that deviates or differs from the density of the suspension stream.

German Patent Publication DE 40 19 593 C2 discloses such a breast box. The addition of the fluid is accomplished therein via inlet openings in the wall of the intermediate chamber.

While the use of such an intermediate chamber can achieve additional advantages, on the other hand, the use thereof means additional expense both in terms of components as well as during the operation of the breast box. All too often the breast box must opened and cleaned in order to, for example, remove obstructions, or changes must be made in the interior thereof for adaptation purposes. During this time, the breast box and therewith the entire papermaking machine is out of operation. Due to this additional component, in the form of a large and heavy intermediate chamber, there is the apprehension of even further extended interruptions.

It is the task or object of this invention to produce a breast box that is comprised of several demountable or removable components that can be separated with relatively little expense in order to provide access to the interior of the breast box. The required constructional expense should be as low as possible.

SUMMARY OF THE INVENTION

This object is fully achieved in one embodiment of this invention via a breast box for a papermaking machine having at least one distribution device, for a material suspension extending over the width of the papermaking machine, at least one adjacent intermediate chamber located downstream of the distribution device, at least one guiding device for the suspension, located adjacently downstream of the intermediate chamber, a nozzle chamber, having a wide aperture, located adjacently downstream of the guiding device, wherein the guiding device, the intermediate chamber and the distribution device are releasably connected with each other and, wherein the intermediate chamber and the distribution device are pivotally journalled about a common fixed pivot axis.

In a further embodiment of the breast box of this invention, the common pivot axis extends horizontally and laterally to the longitudinal direction of the papermaking machine.

In another embodiment of the breast box of this invention, the common pivot axis extends through at least one pillow block fixedly connected with one of the papermaking machine seat and the foundation of the papermaking machine.

In a different embodiment of the breast box of this invention, the intermediate chamber includes a plurality of supply lines for a diluting fluid, with the supply lines being distributed over the width of the intermediate chamber.

In yet further embodiment of the breast box of this invention, the guiding device is also at least partially pivotable about the common fixed pivot axis.

In yet another embodiment of the breast box of this invention, at least one actuating device, for pivoting purposes, is attached to the distribution device.

With the aid of this invention, even at very tight space relationships, with low expense as well as very quickly, correspondingly heavy parts, extending across the entire width thereof, can be tilted or pivoted. Via the reduction of the number of pivot axes to but one, even when using several tiltable components or elements, initially, space is saved. In addition thereto, a common tilting of succeeding or tandem element thus becomes possible. In special cases, commonly tiltable components can be interconnected.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein:

FIG. 1*a* is a partially sectioned schematic side view of the breast box of this invention;

FIG. 1*b* is a portion of the showing of FIG. 1 wherein one element of the breast box has been pivoted relative thereto; and FIG. 1*c* is similar to the showing of FIG. 2, wherein two elements of the breast box have been pivoted relative thereto.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

FIGS. 1*a* to 1*c* show an embodiment of the breast box of this invention. Therewith the intermediate chamber 2 as well as the distribution device 1 are shown as being pivotally connected about a common pivot axis 4 with the foundation or with parts of the papermaking machine seat. The turning or pivot axis can also be anchored with other parts of the breast box. With the aid of the illustrated breast box, maintenance work can be accomplished very quickly, since the distribution device 1 can be tilted alone, as shown in FIG. 1*b*, or can be tilted together with intermediate chamber 2, as shown in FIG. 1*c*. Preferably, hydraulic movement or actuation devices 10 are utilized for these tilting movements, with the actuation devices being either temporarily installed, during the operation of the machine, or being fixedly installed as shown in the illustrated embodiment. As best seen in FIG. 1*a*, nozzle chamber 6 is located downstream of guiding device 3, and terminates in wide aperture or gap 7. FIG. 1*a* also shows supply lines 9, for supplying dilution fluid into intermediate chamber 2, as well as a pillow block 5 fixedly connected with the papermaking machine seat or foundation.

Since the connection between distribution device 1 and intermediate chamber 2, during the tilting or pivoting procedure can be chosen to engaged or disengaged, intermediate chamber 2 requires no additional actuation device. If intermediate chamber 2 is to be tilted, it remains connected to distribution device 1, as shown in FIG. 1*c*, and in the other case it remains connected with guiding device 3, as shown in FIG. 1*b*. Since such actuation devices are known to be quite expensive, the described solution provides further potential savings.

Even though the invention is illustrated in the drawings as but a single layer breast box, it can without further modification also be utilized with multi-layer breast boxes. A multi-layer breast box often includes a distribution device or distributor which, in one component, includes inlets for several layers and which are wholly removable. Even if the breast box could be tilted as several parts, this could be accomplished about a common pivot axis. The same is true for superposed intermediate chambers.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A breast box for a papermaking machine comprising at least one distribution device, for a material suspension extending over the width of the papermaking machine, at least one adjacent intermediate chamber located downstream of the distribution device, at least one guiding device for the suspension, located adjacently downstream of the intermediate chamber, a nozzle chamber, having a wide aperture, located adjacently downstream of the guiding device, and a common fixed axis, wherein the guiding device, the intermediate chamber and the distribution device are releasably connected with each other and, wherein the intermediate chamber and the distribution device are pivotally journalled about the common fixed pivot axis.

2. The breast box of claim 1, wherein the common pivot axis extends horizontally and laterally to the longitudinal direction of the papermaking machine.

3. The breast box of claim 2, wherein the guiding device is also at least partially pivotable about the common fixed pivot axis.

4. The breast box of claim 2, wherein at least one actuating device, for pivoting purposes, is attached to the distribution device.

5. The breast box of claim 2, wherein the common pivot axis extends through at least one pillow block fixedly connected with one of the papermaking machine seat and the foundation of the papermaking machine.

6. The breast box of claim 5, wherein the guiding device is also at least partially pivotable about the common fixed pivot axis.

7. The breast box of claim 5, wherein the intermediate chamber includes a plurality of supply lines for a diluting fluid, with the supply lines being distributed over the width of the intermediate chamber.

8. The breast box of claim 7, wherein the guiding device is also at least partially pivotable about the common fixed pivot axis.

9. The breast box of claim 2, wherein the intermediate chamber includes a plurality of supply lines for a diluting fluid, with the supply lines being distributed over the width of the intermediate chamber.

10. The breast box of claim 9, wherein the guiding device is also at least partially pivotable about the common fixed pivot axis.

11. The breast box of claim 1, wherein the common pivot axis extends through at least one pillow block fixedly connected with one of the papermaking machine seat and the foundation of the papermaking machine.

12. The breast box of claim 11, wherein the guiding device is also at least partially pivotable about the common fixed pivot axis.

13. The breast box of claim 11, wherein at least one actuating device, for pivoting purposes, is attached to the distribution device.

14. The breast box of claim 11, wherein the intermediate chamber includes a plurality of supply lines for a diluting fluid, with the supply lines being distributed over the width of the intermediate chamber.

15. The breast box of claim 14, wherein the guiding device is also at least partially pivotable about the common fixed pivot axis.

16. The breast box of claim 1, wherein the intermediate chamber includes a plurality of supply lines for a diluting fluid, with the supply lines being distributed over the width of the intermediate chamber.

17. The breast box of claim 16, wherein at least one actuating device, for pivoting purposes, is attached to the distribution device.

18. The breast box of claim 16, wherein the guiding device is also at least partially pivotable about the common fixed pivot axis.

19. The breast box of claim 1, wherein the guiding device is also at least partially pivotable about the common fixed pivot axis.

20. The breast box of claim 19, wherein at least one actuating device, for pivoting purposes, is attached to the distribution device.

21. The breast box of claim 1, wherein at least one actuating device, for pivoting purposes, is attached to the distribution device.

* * * * *